343-758 SR
2/5/85 XR 4,498,062

United States Patent [19]

Massaglia et al.

[11] Patent Number: 4,498,062

[45] Date of Patent: Feb. 5, 1985

[54] WAVEGUIDE STRUCTURE FOR SEPARATING MICROWAVES WITH MUTUALLY ORTHOGONAL PLANES OF POLARIZATION

[75] Inventors: Piercarlo Massaglia; Enrico Pagana; Dario Savini, all of Turin, Italy

[73] Assignee: Sip - Societa Italiana Per L'Esercizio Telefonico p.A., Turin, Italy

[21] Appl. No.: 478,864

[22] Filed: Mar. 25, 1983

[30] Foreign Application Priority Data

Mar. 25, 1982 [IT] Italy ..... 67377 A/82

[51] Int. Cl.[3] ..... H01P 1/213; H01P 1/16

[52] U.S. Cl. ..... 333/135; 333/137; 333/251; 333/21 A; 333/208; 333/212; 343/756

[58] Field of Search ..... 333/135, 132, 137, 136, 333/21 A, 21 R, 212, 211, 210, 126, 129, 251, 228, 208; 343/756, 786, 772

[56] References Cited

U.S. PATENT DOCUMENTS

| | | | |
|---|---|---|---|
| 2,432,093 | 12/1947 | Fox | 333/135 X |
| 2,684,469 | 7/1954 | Sensiper | 333/251 X |
| 2,921,274 | 1/1960 | Dascotte | 333/33 X |
| 3,201,717 | 8/1965 | Grosbois et al. | 343/756 X |
| 4,047,128 | 9/1977 | Morz | 333/21 A X |
| 4,410,866 | 10/1983 | Bui-Hai | 333/135 |

OTHER PUBLICATIONS

Article by Robert W. Gruner titled "Compact Dual-Polarized Diplexers for 4/6-GHz Earth Station Applications", published in the 1977 Proceedings of the IEEE Symposium on Antenna Propagation, pp. 341-344.

*Primary Examiner*—Eugene R. LaRoche
*Assistant Examiner*—Benny Lee
*Attorney, Agent, or Firm*—Karl F. Ross; Herbert Dubno

[57] ABSTRACT

A waveguide structure carrying microwaves with two mutually orthogonal planes of polarization and in two different frequency bands, transmitted and received by an associated antenna, comprises two orthomode transducers in the form of coaxial cylindrical guide members of different inner diameters, the smaller-diameter transducer terminating in a short-circuiting end wall while the larger-diameter transducer, adjoining same at an annular shoulder, extends to a feed horn confronting a reflector. Each transducer is formed with two elongate peripheral access slots, opening onto respective rectangular-section branches, which are longitudinally bisected by mutually perpendicular axial planes while being relatively offset in axial direction. Each slot of the larger-diameter transducer is partly traversed by two pairs of conductive dividers, at locations spaced from its ends by about a quarter of the slot length and of a height equal to about a third of the slot width, serving to suppress the propagation of higher modes of higher-frequency waves in the respective branch guides.

12 Claims, 2 Drawing Figures

WAVEGUIDE STRUCTURE FOR SEPARATING MICROWAVES WITH MUTUALLY ORTHOGONAL PLANES OF POLARIZATION

FIELD OF THE INVENTION

Our present invention relates to a waveguide structure for the separation of linearly polarized microwaves in different frequency bands, more particularly but not exclusively with a pair of lower-frequency and a pair of higher-frequency carriers wherein the carriers of each pair are differently polarized.

BACKGROUND OF THE INVENTION

Such a waveguide structure is frequently used, in conjunction with an antenna having a reflector confronted by a radiator or illuminator usually designed as a feed horn, for point-to-point communication via radio links, e.g. between an earth station and a satellite. With two pairs of carriers as noted above, the antenna can simultaneously handle signals on two outgoing and two incoming paths.

A waveguide structure designed to separate the several carriers from one another must provide low-loss coupling between a given carrier and a local signal channel, on the one hand, and must insure proper mutual decoupling of the carriers, on the other hand. Some systems satisfy these dual requirements by the use of separate feed horns and reflecting surfaces of the dichroic type. A more compact arrangement utilizes a single illuminator in cascade with frequency discriminators and polarization separators.

In U.S. Pat. No. 3,731,236 there has been disclosed a waveguide structure, referred to as a diplexer, with two coaxial but axially separated orthomode transducers of circular cross-section interconnected by four flat branch guides of rectangular cross-section which lie in two mutually perpendicular axial planes. The first transducer, having one extremity open to an impedance-matching transformer, has an extension of relatively small diameter at its opposite extremity which merges into a rectangular waveguide for one of two higher-frequency carriers, the other carrier in this frequency range passing through a rectangular waveguide extending laterally from this extremity. The second transducer is of relatively large diameter and also terminates in an axially extending and a laterally extending rectangular waveguide assigned to respective carriers in a lower frequency range.

A paper by R. W. Gruner titled "Compact Dual-Polarized Diplexers for 4/6 GHz Earth Station Applications", published on pages 341–344 of the 1977 Proceedings of the IEEE Symposium on Antenna Propagation, describes a structure with two coaxial circular waveguides for separating carriers of different frequencies, their mutual decoupling being improved with the aid of a corrugated waveguide section.

A problem encountered with rectangular branch guides extending radially from peripheral slots of a cylindrical guide member, designed to convey microwaves within not very distant lower-frequency and higher-frequency bands in the $TE_{11}$ mode, lies in the tendency of such a branch to propagate not only carriers of the lower-frequency band in the fundamental $TE_{10}$ mode but also carriers of the higher-frequency band in the higher-order $TE_{20}$ mode. This results in a significant power loss of the higher-frequency signals which ought to bypass the branch guide in traveling to or from a different output or input port.

OBJECTS OF THE INVENTION

The general object of our present invention is to provide an improved waveguide structure for the purpose described, serving to separate at least one pair of microwave carriers of mutually orthogonal linear polarization, which is of simplified design and reduced weight so as to be readily supported on a tower of the kind used for terrestrial or satellite point-to-point communication.

A more specific object is to provide means for eliminating the aforestated problem of higher-mode propagation in a waveguide structure of this type.

SUMMARY OF THE INVENTION

We have found, in accordance with our present invention, that propagation of a higher-frequency carrier in the $TE_{20}$ mode within a rectangular branch guide laterally adjoining a main guide member of circular cross-section and enabling propagation of a lower-frequency carrier in the $TE_{10}$ mode can be substantially suppressed by a modification of the generally rectangular peripheral slot through which the branch guide accesses the main member, this modification involving the provision of conductor means partly traversing the access slot at locations spaced by about one-fourth of the slot length from each end of the slot while extending over a major portion of the width thereof, i.e. at the site of maximum field strength of waves propagating in the $TE_{20}$ mode. Thus, our improved waveguide structure comprises a guide member of circular cross-section with an open extremity and an opposite extremity reflecting the lower-frequency carrier while giving passage to the higher-frequency carrier, this guide member having an axially extending peripheral access slot of generally rectangular configuration provided with the aforedescribed transverse conductor means. In the presence of two lower-frequency carriers polarized in mutually orthogonal planes, two access slots of the described configuration are respectively bisected by two mutually perpendicular axial planes each of which is the plane of polarization of the carrier designed to pass through the respectively other access slot.

Such a waveguide structure would be useful even in cases in which only one pair of carriers in a given frequency band need to be decoupled from each other, in the presence of microwaves of higher frequency to be guided over a different path. Actually, if only one carrier in the lower-frequency band is to be decoupled from one or more carriers in a higher band, a single access slot of such configuration will suffice.

The conductor means partly traversing such an access slot in accordance with our invention may comprise, advantageously, a pair of metallic dividers symmetrically projecting toward each other, at each of the locations referred to, from the major edges of that slot. We prefer that each divider project into the slot by substantially one-third of the slot width, thus leaving a gap also substantially equaling a third of that width. The dividers may be designed as internal ribs of the associated branch guide or else as screws threaded into same from opposite sides.

BRIEF DESCRIPTION OF THE DRAWING

The above and other features of our invention will now be described in detail with reference to the accompanying drawing in which.

SPECIFIC DESCRIPTION

Figure 1:
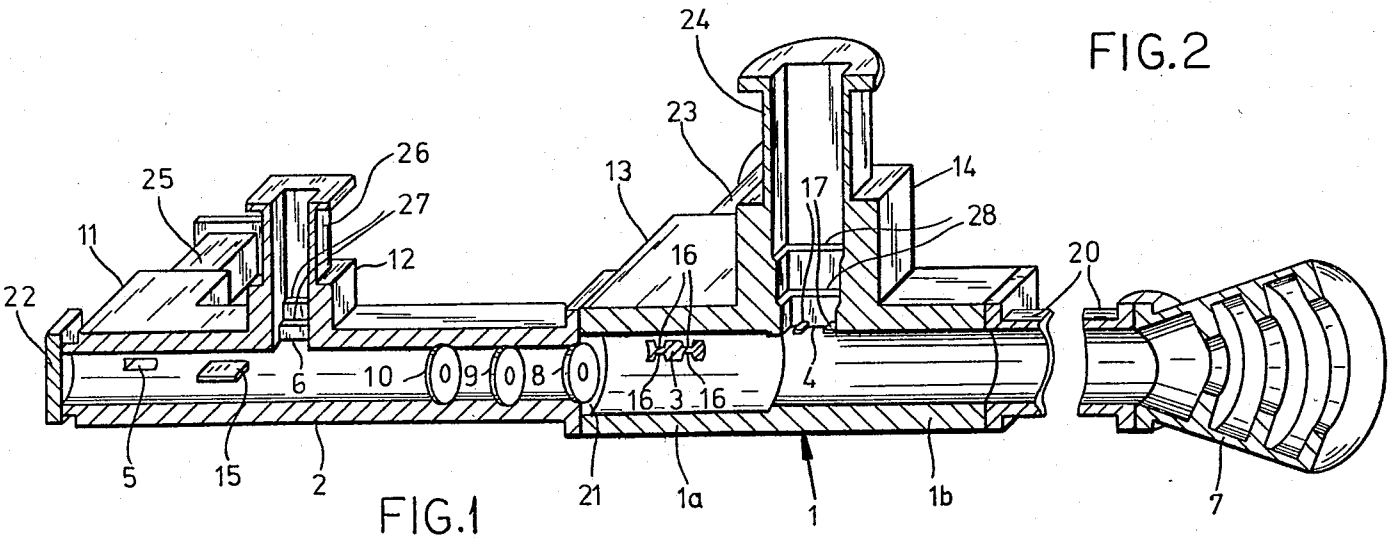
FIG. 1 is a perspective view, in longitudinal section, of a waveguide structure embodying our invention.

As shown in FIG. 1, a waveguide structure according to our invention comprises a first and a second orthomode transducer 1, 2 in the form of cylindrical guide members adjoining each other at an annular shoulder 21 where the structure is stepped down from a relatively large mean inner diameter of transducer 1 to a relatively small inner diameter of transducer 2. Shoulder 21 constitutes a discontinuity reflecting microwaves in a lower frequency band, e.g. between 7.11 and 7.95 GHz, which cannot enter the transducer 2 serving for the guidance of microwaves in a higher frequency band of, say, 10.7 to 11.7 GHz. The higher band, it will be noted, lies below the range of second harmonics of the lower-band frequencies. The latter transducer terminates, at its extremity remote from shoulder 21, in a conductive end wall 22 constituting a short circuit. The opposite end of the structure, i.e. the other extremity of transducer 1, is connected via a cylindrical guide member 20 of like inner diameter to a corrugated feed horn 7 confronting a nonillustrated antenna reflector.

Transducer 1 is provided with two peripheral slots 3 and 4, of generally rectangular configuration, which are longitudinally bisected by mutually perpendicular axial planes and give access to respective branch guides 23 and 24 of rectangular cross-section. Transducer 2 is similarly provided with two rectangular peripheral slots 5 and 6, longitudinally bisected by the same axial planes as slots 3 and 4, giving access to respective branch guides 25 and 26 of rectangular cross-section. Branch guides 23–26 are joined to the main guide 1, 2 by enlarged prismatic bases 13, 14 and 11, 12, respectively, and may also be internally stepped for matching with external guide channels as indicated at 27 and 28 for branches 26 and 24, respectively.

As will be readily understood by persons skilled in the art, two lower-frequency carriers coming from horn 7 with mutually orthogonal linear polarization will traverse the transducer 1 in the $TE_{11}$ mode and will respectively branch out into guides 23 and 24 via slots 3 and 4 for propagation in the $TE_{10}$ mode. Two similarly polarized higher-frequency carriers will bypass the slots 3 and 4 and will enter the transducer 2 for analogous separation by respectively traversing slots 5 and 6 so as to propagate in the $TE_{10}$ mode within guides 25 and 26. Conversely, four microwave carriers to be sent out by the antenna will respectively reach transducers 1 and 2 from guides 23, 24 and 25, 26 and will be conveyed in the $TE_{11}$ mode to horn 7.

In order to avoid disturbing phase shifts between those lower-frequency waves which directly enter the slots 3 and 4 of transducer 1 and those which are reflected at shoulder 21 before passing into the slots, the axial spacing of slot 3 from shoulder 21 should be a small fraction of the mean guide wavelength of the lower-frequency band while the two slots 3 and 4 ought to be axially offset from each other by one or more half-wavelengths. Analogously, slot 5 should be disposed close to end wall 22 while its separation from slot 6 should be one or more halves of the guide wavelength at the center of the higher-frequency band. The inner diameters of transducers 1 and 2 may range between 0.68 and 0.82 times the free-space wavelengths at the center frequencies of the respective bands.

The relative axial offsetting of slots 3 and 4 and of slots 5 and 6 improves the decoupling of the carriers respectively passing through the associated branch guides. However, the greater distance of slots 4 and 6 from the respective reflecting terminations 21 and 22 tends to narrow the effective bandwidth of these slots. This problem can be solved by inserting a metal foil 15, of an axial length equal to half the mean guide wavelength of the higher band, between slots 5 and 6 in an axial plane parallel to slot 6 and thus to the plane of polarization of the carrier traversing same; this foil acts as a reflector for microwaves polarized to pass through slot 6. A similar solution for slots 3 and 4, however, would be inappropriate since a conductive foil there would also reflect the higher-frequency microwaves with the same polarization. We have found that a certain compensation of phase shift between the lower-frequency microwaves reflected at shoulder 21 and thus passing directly between slot 4 and horn 7 can be achieved by axially subdividing the transducer 1 into two guide portions 1*a* and 1*b* slightly differing in inner diameter to introduce an impedance variation, the larger-diameter guide portion 1*a* extending between slot 4 and shoulder 21. Also shown in FIG. 1 are several conductive annular diaphragms 8–10, the first of them being coplanar with shoulder 21, which are axially spaced apart and further decouple the two frequency bands from each other. A further improvement may be achieved by inserting conventional absorption filters, operating in the $TE_{10}$ mode, between slot 3 and shoulder 21.

Figure 2:
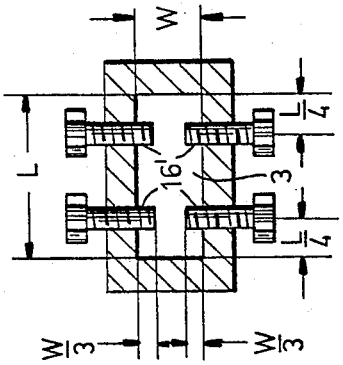
FIG. 2 is an enlarged detail view of an access slot formed in that structure.

The peripheral slots 3 and 4 of the open-ended transducer 1 are partly traversed by conductive elements 16 and 17, respectively. The inwardly projecting conductors 16 of slot 3, which are also representative of elements 17 of slot 4, form two pairs of dividers extending symmetrically from opposite major edges of the slot while leaving a restricted gap therebetween. These divider pairs lie at locations where a microwave propagating in the $TE_{20}$ mode would give rise to a maximum field across the slot, namely at points spaced a quarter of its length from each end thereof. In FIG. 1 the dividers are shown as narrow internal ribs of the associated branch guides 23 and 24, extending only over a short distance in the longitudinal directions of these branch guides from the planes of the respective slots. A similar effect can be had by designing the dividers as screws 16' traversing opposite guide walls. As particularly illustrated for the slot 3 in FIG. 2, which is also representative of a possible modification of slot 4, each element 16' projects into the slot of length L by a distance equal to a third of its width W. The diameter of the screws, like the width of the ribs 16 and 17 in FIG. 1, should be not more than about L/4 which is the distance of a centerline from the proximal minor edge of the slot.

Though the dividers shown at 16, 16' and 17 could be replaced by conductors projecting from only one major slot edge while remaining separated by roughly a third of its width from the opposite edge, such an unsymmetrical arrangement might give rise to depolarization effects which we prefer to obviate by the arrangement shown.

We claim:

1. A waveguide structure for the separation of linearly polarized microwaves including at least one lower-frequency carrier and at least one higher-frequency carrier, comprising a guide member of circular cross-section with an open extremity and an opposite extremity reflecting the lower-frequency carrier while giving passage to the higher-frequency carrier, said guide member having an axially extending peripheral slot of generally rectangular configuration longitudinally bisected by an axial plane perpendicular to the plane of polarization of said lower-frequency carrier giving access to a laterally extending branch guide of rectangular cross-section enabling propagation of said lower-frequency carrier in the $TE_{10}$ mode, said slot being partly traversed by conductor means extending over a major portion of the slot width at locations spaced by about one fourth of the slot length from each end thereof for suppressing propagation of the higher-frequency carrier in the $TE_{20}$ mode in said branch guide, said conductor means including a pair of metallic dividers symmetrically projecting toward each other from the major edges of said slot.

2. A waveguide structure for the separation of linearly polarized microwaves including two lower-frequency carriers with mutually orthogonal planes of polarization and at least one higher-frequency carrier, comprising a guide member of circular cross-section with an open extremity and an opposite extremity reflecting the lower-frequency carriers while giving passage to the higher-frequency carrier, said guide member having first and second axially extending peripheral slots of generally rectangular configuration each longitudinally bisected by an axial plane perpendicular to the plane of polarization of a respective lower-frequency carrier, each of said slots giving access to an associated laterally extending branch guide of rectangular cross-section enabling propagation of the respective lower-frequency carrier in the $TE_{10}$ mode, each slot being partly traversed by conductor means extending over a major portion of the slot width at locations spaced by about one fourth of the slot length from each end thereof for suppressing propagation of the higher-frequency carrier in the $TE_{20}$ mode in the associated branch guide, each of said conductor means including a pair of metallic dividers symmetrically projecting toward each other from the major edges of the respective slot.

3. A waveguide structure for the separation of linearly polarized microwaves including a pair of lower-frequency carriers and a pair of higher-frequency carriers, the carriers of each pair having mutually orthogonal planes of polarization, comprising a first and a second orthogonal transducer of circular cross-section axially adjoining each other, said second transducer having a short-circuited end remote from said first transducer and an inner diameter small enough to prevent propagation of said pair of lower-frequency carriers while accommodating said pair of higher-frequency carriers, said first transducer having a mean inner diameter exceeding that of said second transducer and having an open extremity and joining said second transducer at an annular shoulder reflecting said pair of lower-frequency carriers while giving passage to said pair of higher-frequency carriers, said first transducer being provided with first and second axially extending peripheral slots of generally rectangular configuration each longitudinally bisected by an axial plane perpendicular to the plane of polarization of a respective lower-frequency carrier, said first and second slots giving access to a first and a second branch guide of rectangular cross-section enabling propagation of the respective lower-frequency carrier in the $TE_{10}$ mode, said second transducer being provided with third and fourth axially extending peripheral slots of rectangular configuration longitudinally bisected by the axial planes respectively bisecting said first and second slots, said third and fourth slots giving access to a third and a fourth branch guide of rectangular cross-section enabling propagation of a respective higher-frequency carrier, said first and second slots being each partly traversed by conductor means extending over a major portion of the slot width at locations spaced by about one fourth of the slot length from each end thereof for suppressing propagation of the correspondingly polarized higher-frequency carrier in the $TE_{20}$ mode in the respective branch guide, said second slot lying closer to said shoulder than to said first slot, said fourth slot lying closer to said short-circuited end than to said third slot, said first transducer having a portion of enlarged inner diameter extending between said first slot and said shoulder.

4. A waveguide structure as defined in claim 3 wherein said second transducer is provided with an axially extending metallic foil, of substantially half the guide wavelength of said higher-frequency carriers, disposed between said third and fourth slots in a plane parallel to said third slot.

5. A waveguide structure as defined in claim 3 wherein said second transducer is provided with a conductive annular diaphragm substantially coplanar with said shoulder.

6. A waveguide structure as defined in claim 5 wherein said annular diaphragm is one of a plurality of such diaphragms spacedly disposed in said second transducer between said first transducer and said third slot.

7. A waveguide structure as defined in claim 1 wherein each of said dividers projects into said slot by substantially one third of the width thereof.

8. A waveguide structure as defined in claim 7 wherein said dividers are internal ribs of said branch guide.

9. A waveguide structure as defined in claim 7 wherein said dividers are screws threaded into said branch guide.

10. A waveguide structure as defined in claim 2 wherein each of said dividers projects into the respective slot by substantially one third of the width thereof.

11. A waveguide structure as defined in claim 10 wherein said dividers are internal ribs of the associated branch guide.

12. A waveguide structure as defined in claim 11 wherein said dividers are screws threaded into the associated branch guide.

* * * * *